US011183031B2

(12) United States Patent
Cranford et al.

(10) Patent No.: US 11,183,031 B2
(45) Date of Patent: Nov. 23, 2021

(54) BLACKJACK SIDE GAME AND BLACKJACK TABLE SURFACE

(71) Applicants: Tony A. Cranford, Morrison, CO (US); Cory A. Cranford, Denver, CO (US)

(72) Inventors: Tony A. Cranford, Morrison, CO (US); Cory A. Cranford, Denver, CO (US)

(73) Assignee: Ten Stix Gaming, Inc., Lakewood, CO (US)

( * ) Notice: Subject to any disclaimer, the term of this patent is extended or adjusted under 35 U.S.C. 154(b) by 0 days.

(21) Appl. No.: 17/177,680

(22) Filed: Feb. 17, 2021

(65) Prior Publication Data

US 2021/0264738 A1 Aug. 26, 2021

Related U.S. Application Data

(60) Provisional application No. 62/979,613, filed on Feb. 21, 2020.

(51) Int. Cl.
*G07F 17/32* (2006.01)

(52) U.S. Cl.
CPC ..... *G07F 17/3293* (2013.01); *G07F 17/322* (2013.01); *G07F 17/3209* (2013.01); *G07F 17/3211* (2013.01); *G07F 17/3225* (2013.01)

(58) Field of Classification Search
USPC ..... 463/12, 11, 13
See application file for complete search history.

(56) References Cited

U.S. PATENT DOCUMENTS

| | | | | |
|---|---|---|---|---|
| 7,309,065 | B2 * | 12/2007 | Yoseloff | G07F 17/32 273/292 |
| 9,202,344 | B1 * | 12/2015 | Pao | A63F 3/00157 |
| 9,928,680 | B2 * | 3/2018 | Lutnick | G07F 17/32 |
| 10,242,537 | B2 * | 3/2019 | Morin | G07F 17/3288 |
| 10,909,815 | B2 * | 2/2021 | Donadio | G07F 17/3272 |
| 2005/0035548 | A1 * | 2/2005 | Yoseloff | G07F 17/3276 273/274 |
| 2005/0073102 | A1 * | 4/2005 | Yoseloff | G07F 17/3293 273/292 |
| 2005/0164759 | A1 * | 7/2005 | Smith | G07F 17/3293 463/11 |

(Continued)

*Primary Examiner* — Pierre E Elisca
(74) *Attorney, Agent, or Firm* — Cameron LLP

(57) ABSTRACT

An auxiliary blackjack game to a conventional game of blackjack is played before the conventional game of blackjack is played at a casino or remotely by secure communication to a remote player terminal. A Lucky High Low auxiliary blackjack game is dependent on a special purpose computer processor for determining a card value of an artificial intelligence determined dealer face-up card value and a two card conventional blackjack card hand played by a player. The auxiliary game may be played with as few as one deck. To win a suited three wager, at least three decks of cards may be utilized for play of blackjack and Lucky High Low game. A special purpose computer determines a winning player hand by summing the dealer face-up card value and the two card conventional blackjack player card hand. If the total card value total is 3, 4, 5, 30, 29, 28 or 27, the player wins currency as physical items which may be free game plays or comprise currency or fractional currency.

9 Claims, 6 Drawing Sheets

(56) References Cited

U.S. PATENT DOCUMENTS

| | | | | |
|---|---|---|---|---|
| 2007/0238502 | A1* | 10/2007 | Pokorny | G07F 17/32 463/12 |
| 2014/0024426 | A1* | 1/2014 | Pao | G07F 17/322 463/13 |
| 2014/0031109 | A1* | 1/2014 | Torres | G07F 17/3272 463/27 |
| 2014/0066156 | A1* | 3/2014 | Squitieri | G07F 17/3293 463/12 |
| 2015/0038227 | A1* | 2/2015 | Loose | G07F 17/3258 463/31 |
| 2015/0339892 | A1* | 11/2015 | Pao | G07F 17/322 463/13 |
| 2018/0211471 | A1* | 7/2018 | Lutnick | G07F 17/32 |
| 2019/0168108 | A1* | 6/2019 | Yamaguchi | G07F 17/3206 |
| 2019/0168109 | A1* | 6/2019 | Yamaguchi | G07F 17/3248 |
| 2019/0221078 | A1* | 7/2019 | Hamud | G07F 17/3276 |
| 2021/0264738 | A1* | 8/2021 | Cranford | G07F 17/322 |

* cited by examiner

"LUCKY HIGH LOW" Blackjack

PAYTABLE

30

Players first 2 cards plus Dealers up card equals:

| | |
|---|---|
| Suited 3 | 200 to 1 |
| Any 3 | 100 to 1 |
| Total 4 | 30 to 1 |
| Total 5 | 15 to 1 |
| Total 30 | 7 to 1 |
| Total 29 | 4 to 1 |
| Total 28 | 3 to 1 |
| Total 27 | 2 to 1 |

FIG. 2

BLACKJACK SIDE GAME AND BLACKJACK TABLE SURFACE

This application claims the right of priority to U.S. Provisional Application Ser. No. 62/979,613 filed Feb. 21, 2021, of the same title and by the same inventors.

BACKGROUND

1. Technical Field

The technical field relates generally to the field of video blackjack-type electronic apparatus (similar to a slot machine) and table apparatus games and a blackjack table surface or game display for playing an auxiliary game to a casino blackjack or a video blackjack game and, more particularly, to a game betting position whereby a blackjack player may place a bet related to a high/low card value of a blackjack hand dealt to a player in combination with a face card value of a face-up card of a virtual or live blackjack dealer's hand such as, for example, an ace having a value of one or eleven of a dealer in combination with the value of the two cards of an auxiliary blackjack game player.

2. Background

Auxiliary games are known for playing a known card game such as blackjack. Cranford, U.S. Pat. No. 7,762,879, incorporated by reference in its entirety, describes an electronic blackjack game apparatus and a blackjack game called "Bet the House Blackjack." An auxiliary game permits a player to place a bet on what the dealer's hand will be, as well as to place bets on a hand dealt by the dealer (or issued by the gaming apparatus) to the player. In particular, the player may bet that the dealer, for example, will deal himself a seven card hand which would pay, for example, 6500 to 1 odds and thus reap for the player a $6500 pay-off for a one dollar bet. If the dealer deals himself an all red hand, the pay-off to a player playing the auxiliary "Bet the House Blackjack" game would be about 5 to 1 or the player would receive $5.00 for a one dollar bet.

The present applicant, Mr. Cranford, has also been issued U.S. Pat. No. 5,769,422, which also describes a variation on a blackjack card game and apparatus. In this variation, the banker and the player are each dealt one card, and the player makes an initial wager limited at least by an amount placed in the "bank" by the banker. Once a second card is dealt to each player, the player may stand on their hand or take another card. The banker may then accept cards until a winner is determined by conventional blackjack rules.

Other auxiliary games are known for casino gambling and virtual play. Stromer, U.S. Pat. No. 8,303,3922, describes an electronic video poker game allowing a player to place more than one auxiliary bet such as no pair which may act as a hedge against obtaining a much better hand and winning a poker pot, for example, with four of a kind. Other outcomes may be selected before a poker game begins such as two pair, straight, full house and the like. The pay-off for no pair is merely 1.5 to 1 while for a full house, the pay-off may be 80 to 1.

Also, new card games have been invented and issued as patents since the America Invents Act and the Supreme Court have instituted an abstract idea exception and may comprise patent ineligible subject matter. Pao, U.S. Pat. No. 9,202,344 issued Dec. 1, 2015, for a Pair 9 Poker Plus card game and virtual game machine. Wages and payouts in physical items or virtual items may be electronic, currency or virtual currency that are validated and, if accepted, establish credit for game play and may likewise be used for payout to a game player.

Cranford et al., U.S. Pat. No. 5,718,427, describes a high-capacity automatic playing card shuffler. A card-holding bin may hold eight decks of cards and may be dispensed one, two or three cards at a time having been shuffled into random order. Such a card shuffler is often used for the play of blackjack by a live dealer. All U. S. patents briefly described above are incorporated by reference in their entirety herein as to the use of game terminology, electronic play, special purpose computers and game rules which may comprise computer programs and memory.

While there are many known variations of blackjack table card games and of virtual blackjack games playable on electronic apparatus, there remains a continuing demand for fun auxiliary games to conventional blackjack games and means for adapting known table card games such that they may be played on video electronic gaming apparatus or with a virtual dealer. There remains a need in the art to further improve on variations of known blackjack table card games and video blackjack games. It is also desirable to provide a player with greater enjoyment and opportunities as well as greater potential profit or fun for the blackjack apparatus owner or casino owner of the "house" in a blackjack card or auxiliary game.

SUMMARY OF THE EMBODIMENTS

Embodiments of a known card table game of blackjack, sometimes called twenty-one, may be enhanced by the play of an auxiliary game to the known blackjack card table or electronic apparatus game. Moreover, such an auxiliary blackjack game may be implemented as an auxiliary game to a known electronic blackjack gaming apparatus or blackjack casino table. The auxiliary game or set of such games may be referred to herein as a Lucky Hi Low blackjack side bet. In particular, in embodiments either of a blackjack card game table surface or of an electronic video blackjack game, a virtual card dealer robot, additional betting positions, buttons, keys or virtual keys may be provided for placing or selecting an amount of a wager or bet in an auxiliary blackjack game referred to herein as Lucky Hi Low blackjack. Each normal wager position, for example, may be represented by a circle where a blackjack hand may be dealt to a player, for example, by a virtual dealer. As in casino blackjack, a player may play more than one hand at a time. Adjacent to the circle may be a rectangle or box for placing a Lucky Hi Low bet. The display or game table surface may provide an explanation of the blackjack house rules and additionally provide a simplified explanation of Lucky High Low blackjack.

As a dealer or virtual dealer, which may be a robotic machine, announces a new blackjack game to begin, a player decides whether to just play blackjack or twenty-one in a conventional known manner according to house rules (such as maximum bet size and the like). (The robotic virtual dealer machine may comprise an automatic card shuffler and dispenser, microphone input device, speaker output device, camera output device and comprise a block diagram as per FIGS. 4, 5 and 6.) The dealer, virtual dealer or a blackjack gaming apparatus will display a "pay table" showing, for example, that an auxiliary Lucky High Low blackjack side game will relate to the first two cards dealt or displayed to a player and the Dealer's face-up card. The Low opportunity of the game is that the first two cards plus the card value of the dealer's face-up card may be as low as 3 since an ace may be the dealer's face-up card and the player may have received two aces as his initial hand. Since an ace typically has a value of one or eleven, it may be counted as a one. So the lowest card value a blackjack player playing the auxiliary Lucky High Low blackjack game is three—three aces totaling three points. If a player bets a side bet in Lucky High Low blackjack as the player plays his blackjack hand normally, the dealer will stop game play after reaching the point where the dealer has turned a card face up and the players of Lucky High Low blackjack have been dealt their first two cards and the player chooses to show their first two cards dealt to them to win at the Lucky High Low blackjack auxiliary game. In order to obtain a score of three aces totaling 3 in one suit, there must be a minimum of three decks of cards shuffled by an automated shuffler or randomly output by a machine comprising a special purpose data processor, a memory, an input device and an output device.

The card value of the player's first two cards and the dealer's face-up card is then calculated. If the card value of 3, 4 or 5 are calculated (four or five in any combination of three cards that add up to four or five) a winner on the low side is declared. For example, a card value of five among the three counted cards may pay fifteen to one. Three aces add up to a card value of three, and a player will win at least one hundred times the side bet value in the box or rectangle. A special case is called a "suited 3" where all three aces are of the same suit, for example, the dealer and a player holds two aces of spades and the dealer, one ace of spades. In this case, the apparatus or dealer pays two hundred times the value of the Lucky High Low blackjack side bet. Also, the dealer must play with a card deck size equivalent to at least three standard decks of fifty-two cards each. Many blackjack conventional games are played with more than three decks of fifty-two cards each.

On the high side, payouts are less. An example is that a card value of thirty is possible by the dealer or player receiving a card value of thirty by any combination of three card values that add up to thirty. For example, the dealer may have a ten, jack, queen or king and a High Low player may likewise have a ten, jack, queen or king as one or both of their two-card hand. The payout for such a score of thirty is seven to one. For every dollar bet, the player wins seven dollars. Also, aces count as either one or eleven so the total of thirty may be reached in card value by including aces at a value of eleven and, for example, a winning card value of thirty may be achieved by an ace, a nine and a ten valued card such as a ten, jack, queen or king. A card value of twenty-nine pays four to one. A card value of twenty-eight pays three to one. A card value of twenty-seven pays just two to one. Blackjack game play is halted while the electronic apparatus or casino dealer either collects the Lucky High Low bets that are lost by the player or pays the player for a winning high or low card value.

According to one embodiment, the video blackjack or blackjack card table game may, for example, then continue. A player will call whether they want to stand pat or take an additional card value in the hope of reaching twenty-one. Of course, if the card value of a hand of conventional blackjack may exceed twenty-one if a player takes too many cards and goes "bust" for exceeding a card total value of twenty-one.

Moreover, unless a bet is placed in the circle for regular blackjack, no bet may be placed in the auxiliary game rectangle spot for Lucky High Low blackjack. The house may limit the bets placed on conventional blackjack to between one dollar and two thousand five hundred dollars by way of example and simultaneously limit the auxiliary side bet for Luck High Low blackjack to between one and fifty dollars. The circle and rectangle are just mentioned by way of example. A conventional blackjack betting spot may be of any geometric shape, even the logo of the casino, and the same applies to a Lucky High Low bet as long as the spot for the side game bet is different from a conventional blackjack spot. Lucky High Low blackjack may be optionally played on either electronic apparatus or as a casino game or remotely from a casino if gaming is permitted in that state or country. The appropriate payoff bet for Lucky High Low blackjack may be determined by a computer processor as the pay-off changes with the card value dealt in the first three show cards.

An interesting outcome of such an auxiliary game such as Lucky High Low blackjack to a blackjack game is that a player may play against themselves and/or strive to achieve a card value of twenty-one according to conventional blackjack. For example, a player may place a Lucky High Low wager that their hand will have a three-card total value with the dealer of five (a low bet). A five-card value suggests that the player may have a pair of deuces. The player may proceed after winning Lucky High Low blackjack to receive a larger pay-off based on their card value as they continue to reach a card value that may be less than going "bust" but beat the dealer, starting with a show card of, for example, a two.

Although the game of video blackjack is accepted across the United States and many foreign countries, it would be desirable to provide certain improvements. For example, it would be desirable to provide modifications to the game to make the game more exciting and more interesting. In addition, it would be more desirable to allow players to make different wagers in which they would have the opportunity to win larger amounts of money from a single wager. It would also be desirable to provide for automatic casino play by designing a virtual robotic dealer having artificial intelligence and capable of supervising the game with cameras, a card shuffler and dispenser and a camera with the artificial intelligence computer program to determine what card of the dealer's hand to turn face up and to recall what blackjack hand was dealt to each player position about the table. It is expected that one of ordinary skill may adapt the principles of embodiments of an auxiliary Lucky High Low auxiliary game disclosed herein to many different forms of blackjack card games including further additional auxiliary blackjack games offered at the same time as conventional blackjack without conflict between auxiliary games and conventional blackjack.

Further embodiments to those described above and below provide both a method and apparatus for playing auxiliary Lucky High Low blackjack games that provide a unique opportunity to not only play standard Video Blackjack/card table blackjack but make a new and unique wager not available on any other form of Video Blackjack or card table blackjack. In this way, the player has an opportunity to play multiple conventional blackjack hands and at least one Lucky High Low blackjack hand per conventional blackjack hand.

A pay table is shown below which under low and high card value, the card value is the sum of the face-up card of the dealer and the player's first two cards of a conventional blackjack hand. The following table provides exemplary card values and payoffs before a player blackjack hand is played in a conventional manner:

| Low Card Value | Payoff (Example could be variable) |
|---|---|
| Suited 3 (same suit) | 200 to 1 |
| Any 3 | 100 to 1 |
| Total of 4 | 30 to 1 |
| Total of 5 | 7 to 1 |
| **High Card Value** | **Payoff (could be variable)** |
| Total of 30 | 7 to 1 |
| Total of 29 | 4 to 1 |
| Total of 28 | 3 to 1 |
| Total of 27 | 2 to 1 |

By introducing this unique pre-hand wager as an opportunity to a player, the player is provided with an exciting new alternative to a conventional game of blackjack that is not currently available: For example, in addition, the player is provided with some interesting new strategies of hedging their initial wager with the new optional wagering positions of the auxiliary blackjack game. By incorporating these new aspects to an embodiment of such an auxiliary blackjack game, a video blackjack display or poker table surface product may be provided that is currently not available in the market but may provide enhanced enjoyment to the player and additional revenues to a machine owner or casino manager.

Further features of embodiments of a Lucky High Low auxiliary blackjack game will become more clear from a brief and detailed description of the drawings which follows wherein like reference numerals are intended to refer to similar elements throughout the drawings.

BRIEF DESCRIPTION OF THE DRAWINGS

FIG. 2 shows a pay table 30 seen in FIG. 1 of card values and related payoffs for a Lucky High Low blackjack side game. Simple instructions: "Players first two cards plus Dealer's up card equals:" provide a player with instructions of winning play.

FIG. 6 is an example of a block schematic diagram of exemplary electronic gaming apparatus for playing a conventional blackjack game concurrently with offering one or more auxiliary blackjack games such as Lucky High Low Blackjack and Bet the House blackjack comprising an input device, an output device, a computer data processor and a secure communications interface to the network 13 of FIG. 5 and remote game apparatus 40. The block schematic diagram may represent a robot virtual blackjack dealer (in combination with a card shuffler), an electronic game machine, a remote player apparatus and other apparatus as discussed or referred to in the present provisional patent application.

Figure 3:
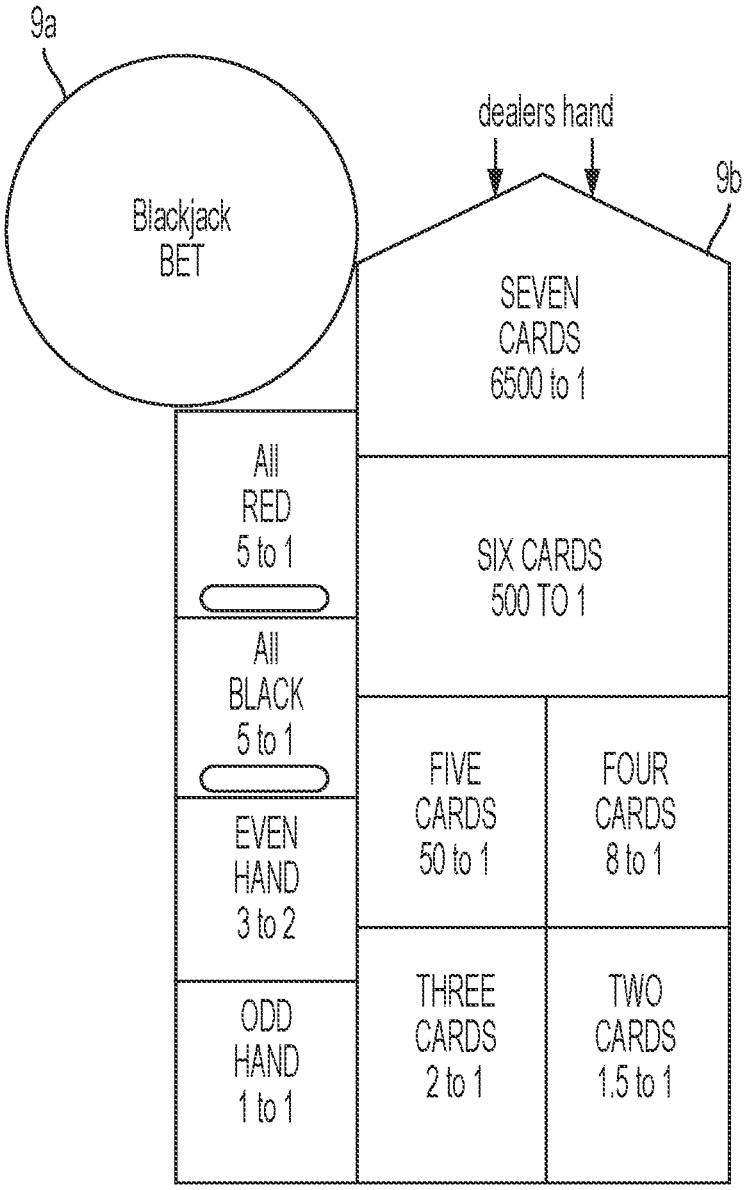
FIG. 3 provides a further exemplary table position referred to herein as a Bet the House blackjack auxiliary game pay table where the conventional blackjack bet is received in circle 9*a* (analogous to circle 10 of FIG. 1). More than one blackjack side game and pay table may be played at a time. Bet the House Blackjack permits an auxiliary wager on what the final result of a dealer's hand will be. The wager must be placed prior to the beginning of conventional play. It is important to note that the present invention envisions that various combinations of blackjack auxiliary games may be played at the same time as a conventional blackjack game either via an electronic apparatus or at a casino gaming table. The blackjack table 100 may comprise FIG. 3 as well as the pay table 30 of FIG. 2 for the Lucky High Low blackjack side game. The conventional Blackjack BET circle 9*a* may be circle 10 and removed from the pay table and instructions and five-sided polygon of table 9*b*.

These and other features will be further described in the detailed description of embodiments of the Lucky High Low auxiliary blackjack game played concurrently with a conventional blackjack game and additional blackjack side games per FIGS. 2 and 3 or other side games which do not conflict with one another which follows.

DETAILED DESCRIPTION

Referring now to FIGS. 1-6, embodiments and rules of play of an auxiliary blackjack game referred to herein as Lucky High Low blackjack will be described wherein like reference numerals refer to like elements.

Figure 1:
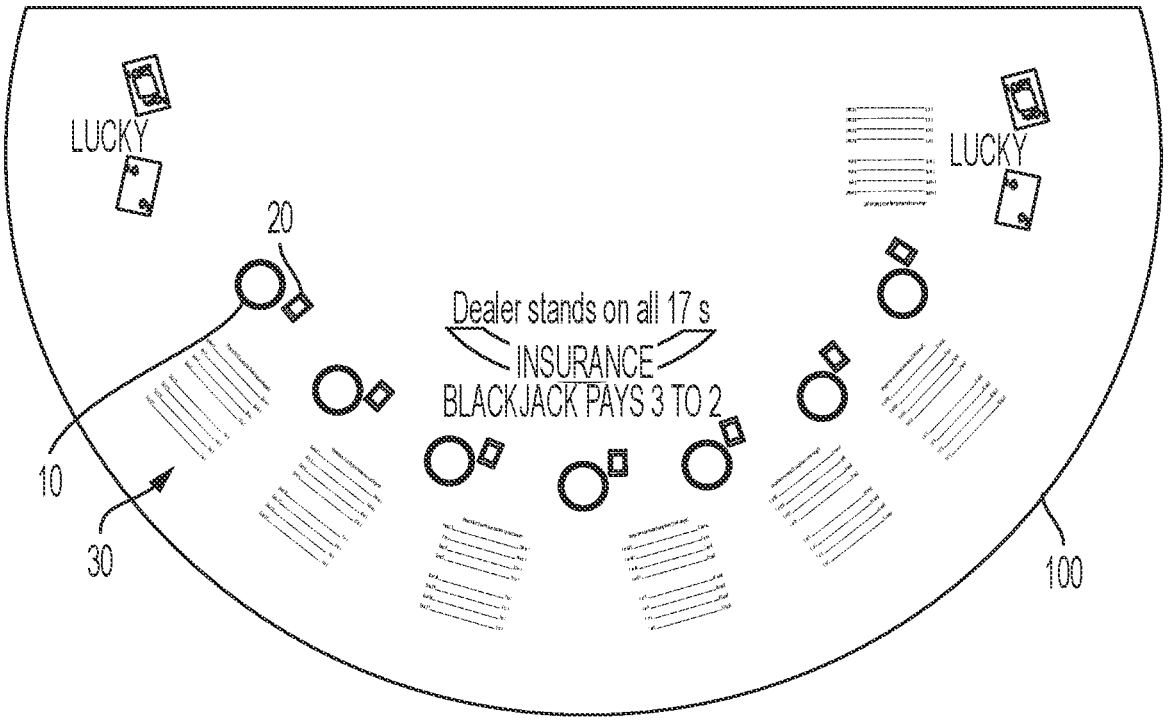
FIG. 1 is an exemplary blackjack table position 100 which comprises both a conventional blackjack circle 10 and a Lucky High Low auxiliary game position 20 referred to herein as the box or the rectangle 20 proximate the conventional blackjack circle betting spot 10, which may likewise be a display, collection of buttons, keys or virtual key panel of an auxiliary game to a known video blackjack game in the form of apparatus. A Lucky High Low auxiliary blackjack game pay table 30 is also shown and may be better seen in FIG. 2. The pay table, herein, may be defined as both providing the pay-off for a given side game bet and instructions for play of the side game. Moreover, the Lucky High Low betting position 20 may be for placing bets on one of a plurality of auxiliary blackjack games such as Bet the House Blackjack as will be further discussed herein with reference to FIG. 3.

Referring first to FIG. 1, there is shown an exemplary conventional blackjack game tabletop or electronic display 100 where a player position 10, 20, 30 comprises a circular betting spot 10 for conventional blackjack betting. An auxiliary game layout area 20 may be a rectangle, square, box or other area specific to a blackjack side game. According to the table layout shown, a dealer faces a semicircular conventional table 100 and deals cards, for example, to each of seven player positions 10, 20, 30 shown for one player of a conventional blackjack or side table game. The table area 100 may comprise a semicircular or other shape where players may sit or stand at any of the seven (more or less) blackjack and side game positions 10, 20, 30. A blackjack player may play more than one hand at a time and occupy, for example, two or more positions, preferably next to one another. Also, the invention contemplates that physical or virtual items may be utilized by a player for the purposes of wagering on a game or one or more side games by means of an electronic device as will be further discussed with reference to FIGS. 4, 5 and 6.

Referring to FIG. 2, there is shown an enlargement of an exemplary pay table 30 (pay-outs and instructions) of FIG. 1 with a brief synopsis of dealt card values of a face-up dealer card and the first two cards of a blackjack hand. Once these initial cards are dealt or displayed, the side blackjack game of Lucky High Low blackjack is played, provided the player places a wager in the conventional circle game spot 10 (FIG. 1). Lucky Hi Low is an optional side wager that can be offered with a conventional blackjack game. The wager and payout is based on the blackjack total of the first two cards dealt, for example, to the betting spot 20. and the dealer's up card. Like conventional blackjack, aces count as either one or eleven. The bet wins if the total of the three cards equal one of the winning totals listed in the pay table 30 of FIG. 2. For example, for a six-deck game, a higher amount is awarded for a same suited total of three (three aces of the same suit). Lucky High Low is played on a standard blackjack table and does not require house blackjack game rules to change. If a player plays a conventional blackjack hand to a card value the player is satisfied with such as twenty-one, so be it. The player of the conventional game still has to have a card total that equals less than or equals twenty-one, exceeds the card value of the dealer's hand and is not a "bust" or exceeds the best card value of twenty-one.

Lucky High Low blackjack wagers are decided and acted upon independently of any conventional blackjack game decisions after a hand is dealt. For example, a dealer's potential for a winning blackjack hand will not affect the result of a Lucky High Low auxiliary game. A machine's potential, as will be further explained herein, relies on artificial intelligence to, for example, determine which of the virtual two card blackjack hand to turn face up and display the card by suit and denomination by simulation. A player may be required to make a regular blackjack wager meeting the table (house) minimum in virtual or physical items validated by the dealer or casino before the player may qualify to make a Lucky High Low auxiliary game wager. The conventional blackjack table minimum may be any value of virtual or physical currency such as ten US dollars. If a player chooses to participate, an additional $1.00 up to, for example, a maximum of $50.00 (machine or casino option) may be bet on the Lucky High Low bet position 20. A player may only place a Lucky High Low wager on a hand that they are playing. The player may not place a wager on another player's hand. On the other hand, since a player may play more than one conventional blackjack hand, a player may place a Lucky High Low wager at any one or more of the seven player positions that the player is personally playing.

Players of Lucky High Low may not wager more in physical items than on their conventional hand. While physical items may be based on any of a validated credit card limit, tokens issued by the casino, chips (which may be electronic), currency available validated by a bank query and the like, the player may not wager more on the Lucky High Low two cards plus dealer face-up card if the player chooses to participate than on their conventional blackjack hand (casino or machine limit). Preferably, in the United States, any physical item validated by the machine or the casino for play should be immediately convertible to U. S. dollars. (In foreign locations where the casino virtual game is located or the casino table game, the currency conversion required may be to Euros or other local currency.)

As already introduced, a virtual hand of a player and the artificial intelligence generated virtual dealer card chosen for face-up display is calculated by the dealer or by a special purpose computer processor running a Lucky High Low blackjack computer program application and/or another blackjack side game; (see FIG. 3).

Referring briefly to FIG. 2, a Lucky High Low wager in validated physical items may determine the value of a bet that may be placed by the player 1 (for example, an output device 620 such as a display may show the player 1 his betting limit depending on validated currency that the player 1 may wish to bet and the player's potential maximum winnings from the player pay table (for example, per FIG. 2 or 3 as determined by the casino) and stored in machine memory 610. Similarly, if played at a casino, the player 1 must demonstrate sufficient funds to play, and the dealer or machine (FIG. 6) will use the pay table 30, FIG. 3, to determine if a maximum win exceeds a house limit. A Lucky High Low wager placed at bet position 20 wins if the total of the dealer's up card (artificial intelligence determined if a machine) and the two card value of the player's two card value total either a High pay-out or a Lo payout, the Lo payout being greater than the High payout, for example, for a three card total value of one of suited 3, 3, 4, 5, 30, 29, 28 and 27. A Lucky High Low wager at spot 20 is collected by the machine 15 or by the dealer if the dealer or the machine (15, FIG. 6) determines that the card value total of the three cards totals any other amount.

In conventional blackjack, a player's hand is dealt with one face card showing and one card not showing. To collect a winning bet, the player may see or be displayed his down card value and determine if the player is a winner at Lucky High Low blackjack from his initial two card hand. If so, the player signals the machine 15, FIG. 6 or turns his down card over to show the dealer so that a winning hand (with the dealer's face-up card) may be determined. The player at a casino may request that the next card if he takes a "hit" will be turned face down. By house rules, the player is entitled to one down card.

Figure 6:
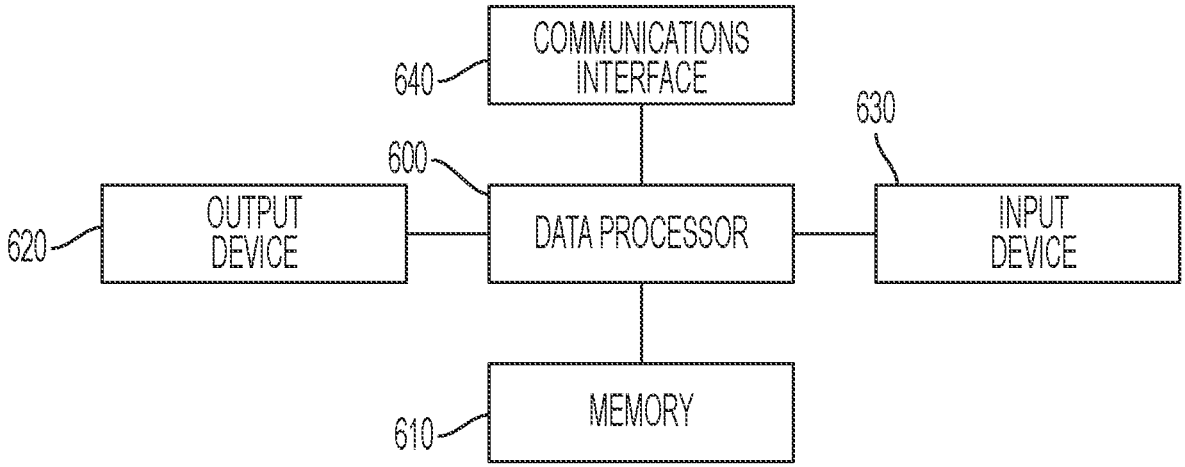
FIG. 6 is an example of a block schematic diagram of exemplary electronic gaming apparatus for playing a conventional blackjack game or a conventional blackjack game concurrently with offering one or more auxiliary blackjack games such as Lucky High Low Blackjack comprising an input device 630, an output device 620, a computer data processor 600, a memory 610 and a communications interface 640 to the secure network 13 of FIG. 5 and remote game apparatus 40. The block schematic diagram may represent a robot virtual blackjack dealer (in combination with a card shuffler), an electronic game machine, a remote player apparatus 40 and other apparatus as discussed or referred to in the present patent application.

The machine or the dealer determines whether a player is a Lucky High Low auxiliary side game winner and may be paid with physical items according to the pay table of FIG. 2 (or other house rule). A maximum amount allowed for a dealer's "toke" bet, is determined by artificial intelligence and governed by house rules as, for example, input to machine memory 610 (FIG. 6). In casino play or machine play, a telecommunications signal or other signal may be transmitted to a casino supervisor when a player is betting a maximum wager such as $50 (position 20 and payout for Suited 3 per FIG. 2 pay table) may result in a loss of $1,000 at 200 to 1). In reverse, a signal may be sent to the dealer or the machine limiting the Lucky High Low payout to, for example, $1000 or less. The machine (FIG. 6) may notify the player of the house rule and limit the bet as the bet is placed (at a machine) or slightly later by a dealer. Any wager value in excess of the house rule limit will be refunded by the machine or dealer. In a casino setting, a pit manager may notify surveillance and implement video apparatus to watch the player playing Lucky High Low blackjack and verify (validate) any payouts, for example, of $1000 or less.

Now, Lucky High Low blackjack auxiliary game machine or dealer processes will be discussed. The machine (15, FIG. 6) will randomly deal the cards from, for example, six fifty-two card decks, and the dealer will take cards from a card shuffler of, for example, a six-deck card shuffler for display or for presentation on the casino table of FIG. 1. As mentioned before, a Lucky High Low wager may be validated once attempted by a player before any cards are dealt in a blackjack conventional game by artificial intelligence of a special purpose data processor 600 or a dealer in accordance with house rules.

A machine (15, FIG. 6) uses a random card table, for example, comprising six decks of cards by suit and value to deal the cards, and the dealer or a virtual dealer may deal from the card shuffler. Once all cards are dealt and prior to any draws being made, the machine or the dealer starting from a first position to a last position of players (typically from first or the right of the dealer to the left will pay or collect all Lucky High Low wagers at spot 20 and refund any bets over a predetermined house limit. Machines will indicate by display a number of physical items deposited to a bank account or credit card or other source of currency in denominations of the location of the player (for example, in dollars or euros).

Players are only entitled to one payout per hand (the highest win value determined by house rules) for each hand played during a round, displayed by the machine or validated by the dealer of a Lucky High Low pay table 30. At a casino, if the player does not turn their two card values face up, a dealer may assume that the player does not have a winning Lucky High Low hand with his face up card and take the player's bet from the table spot 20 and move the wager, for example, to a chip tray where the value collected may be counted and compared with the player's winnings for determining surveillance measures. After all Lucky High Low bets have been handled by a machine or by a dealer, a conventional blackjack game continues, for example, by a player saying whether they want a "hit," a further card having a value to be added to their present card value of their own hand (not including the face card of the dealer) to reach their personal safe value such as seventeen to twenty-one. Of course, all card games and auxiliary side games may be played for fun and for no expected currency return. A player may freely practice and play conventional blackjack and Lucky High Low blackjack, for example, to enhance their skills at decision-making as suggested by FIG. 4.

Referring briefly to FIG. 6, a label such as Pot Shot Poker may identify an auxiliary video poker game portion of a video poker apparatus to distinguish the Pot Shot Poker portion from features of video blackjack game apparatus. Money may be deposited or accepted, for example, as any acceptable currency. Currency, if permitted by the local jurisdiction, may be entered by any means acceptable such as electronic funds transfer (EFT), credit card, debit card or other financial transfer to purchase credits for playing the Pot Shot Poker apparatus or blackjack apparatus.

Referring briefly to FIG. 3 taken from Cranford, U.S. Pat. No. 7,762,879, Bet the House Blackjack is a second auxiliary side game that may have a betting position as show where a conventional blackjack wager is placed in Blackjack circle bet spot 9*a* moved to position 10. An object or goal of a player of Bet the House blackjack is to guess what the dealer's hand will be and place a preliminary wager on any of the positions 9*b* ranging from seven cards in length (highly unlikely) and paying 6500 to 1 or simply whether the card value is odd or comprises three cards paying only two to one or is an odd valued hand paying only 1 to 1. The point of discussing this figure is that more that one auxiliary side blackjack game may be offered by machine 40, 15 or by a special purpose computer apparatus per FIG. 6 and a casino table top 100 per FIG. 1 may be modified to show two side games or more. In this case, the two different auxiliary games of blackjack do not conflict with one another or play of conventional blackjack. One auxiliary game evolves from card values of a dealer's hand and a player's two card initial hand and the other deals with a dealer's hand at the end of a conventional game and a bet position of FIG. 3 by a player. Other bet positions shown may comprise a dealer's six card hand paying 500 to 1, a five-card hand paying, 50 to 1, a four card hand paying 8 to 1, an all red or all black hand paying 5 to 1.

Figure 4:
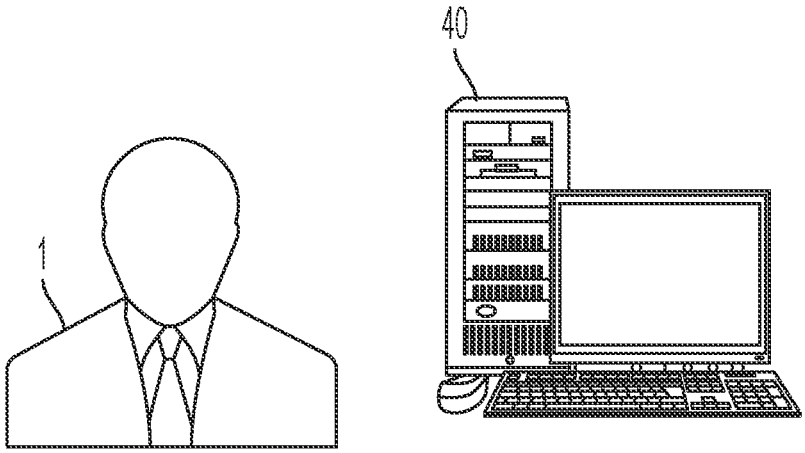
FIG. 4 shows a player 1 of electronic gaming apparatus for conventional blackjack which may be supplemented by appropriate computer programming of the electronic apparatus for use by the player 1.

FIG. 4 shows a typical player 1 and personal or remote apparatus 40 for playing conventional blackjack and a Lucky Hi Low blackjack auxiliary game. An application for playing blackjack games may be downloaded to the apparatus 40 (if gaming is permitted in the state where a player is located) which may be for fun (no permission needed) or played via conventional secure telecommunications apparatus such as a known cell phone (Apple, Samsung or other brand) 40 running the blackjack application for remote play over secure telephone line to a casino. If the player plays for fun, the application may be downloaded from a game supply site such as Apple, Google or Samsung or other game store; if played for profit, from the casino or other central gaming facility. The application may be licensed by the player 1 and be free or chargeable to a credit card that may be preserved in memory of the game distributor, game store or casino. The player 1 may play by themselves and determine when they are winning or losing or may reactivate scoring if the player 1 wants to try again. The apparatus 40 may be a cell phone, a computer or any apparatus that may download a computer application to apparatus 40. The apparatus needs to comprise similar apparatus to the special purpose computer processor and, if appropriate, a secure communications interface 640 shown in FIG. 6 (for profit).

Figure 5:
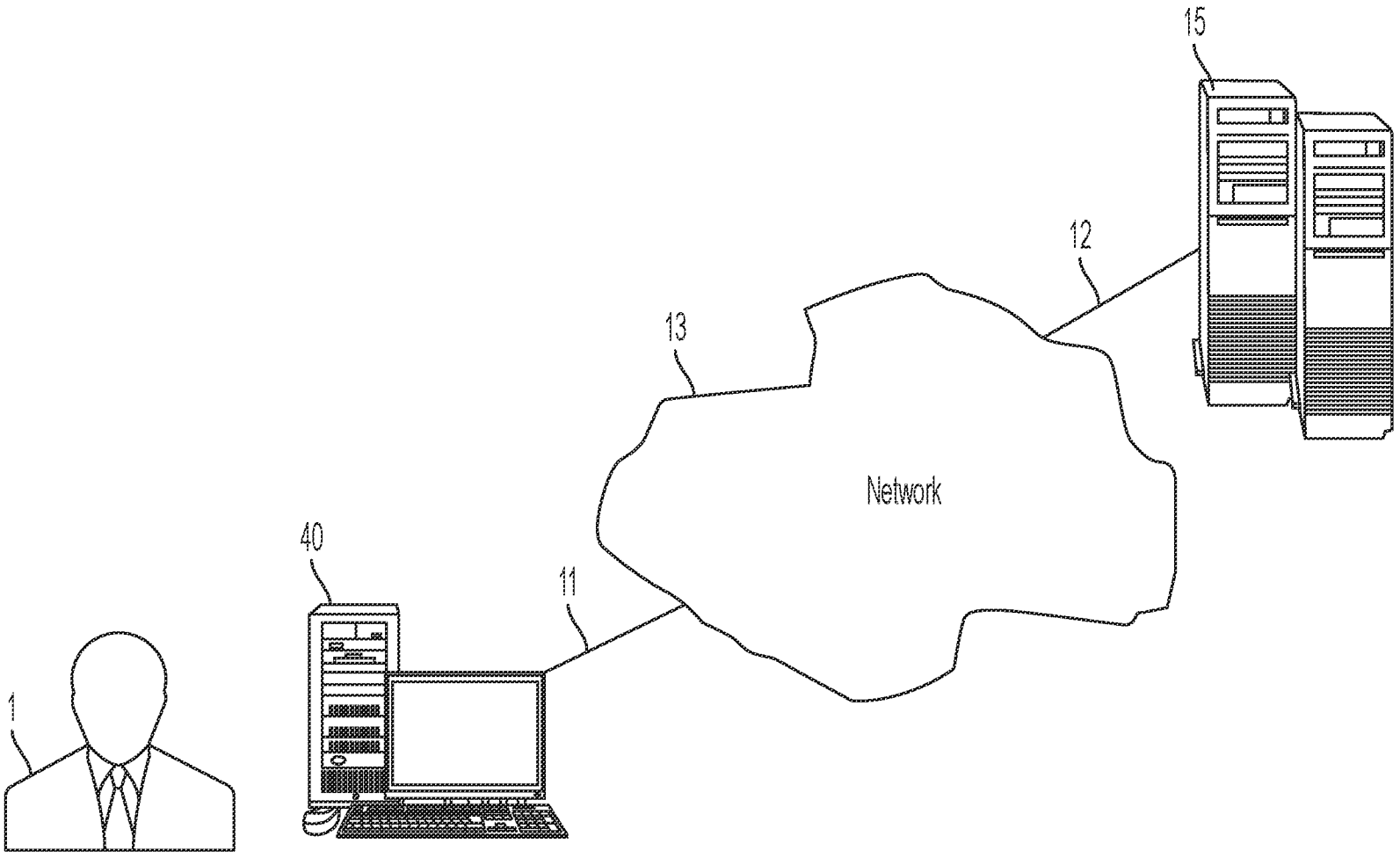
FIG. 5 shows network apparatus whereby a conventional blackjack game and one or more side games may be played remotely by a player 1 at personal apparatus 40 connected by conventional secure digital telecommunications facilities to a network 13. The network 13 may be connected to a casino offering the blackjack gaming services via conventional secure telecommunications (including satellite) facilities to virtual blackjack gaming apparatus 15 including one or more auxiliary blackjack side games and a simulated conventional blackjack game.

Referring to FIG. 5, remote wagering via a special purpose apparatus of FIG. 6 is shown which may include apparatus personal to the player such as a cell phone or other remote apparatus 40 of FIG. 4. Player 1 is presumed to have a conventional telecommunications device 40 as per FIG. 4 or 6 comprising a downloaded game from a game distributor or a casino. Should a winning card value of Lucky High Low blackjack be recognized by computer apparatus 15 at a gaming site, the apparatus 15 of FIG. 5 will utilize secure telecommunication lines 11 and 12 via a network 13 (which apparatus 15 may also communicate to validate a player and their currency and their betting potential) validate a player limit to be higher than a house limit. Only the house limit will be paid as stored in memory 610 or be known to the casino. As an example, should the player hold two aces of spades and the dealer have chosen an ace of spades as an up card, the potential winning wager may exceed house rules. Only the house limit will be paid and any excess Lucky High Low wager will be refunded, for example, in the currency of the remote location to the player's bank account.

Referring now to FIG. 6, there is shown an exemplary special purpose computer for supervising a conventional game of blackjack and offer Lucky High Low blackjack as an auxiliary game. The special purpose computer shown in FIG. 6 has a secure communications interface 640 which communicates securely with a player's cell phone or computer running the player's Lucky High Low computer game software. The special purpose computer data processor 600 provides game play, odds calculations if necessary, "fun"

game total winning calculations, if necessary, pay-off calculations for both conventional and auxiliary Lucky Hi Low game play, accepting inputs such as wagers, validating wagers and generating choices of players and dealers, such as generating choices via artificial intelligence for, for example, dealer face-up card via fair game simulation and obeying house rules. The apparatus of FIG. 6 may be robotic in nature and work with a card shuffler to dispense cards, value cards dealt and deal conventional blackjack and auxiliary blackjack games as a virtual dealer at a blackjack table as shown in FIG. 1.

Wagers and the like are in physical items as defined above that may be collected from a bank account, a valid debit or credit card where the valid currency value of a valid debit card (or credit card) is determined from an institution such as a bank or corporation such as American Express via secure communications links to the banks or corporation not shown in FIG. 5 or 6. Element 600 may be a data processor known in the art programmed as a special purpose computer for playing conventional and Lucky High Low blackjack according to the rules. Alternatively, element 600 may comprise a programmed array of electronic circuits (integrated circuits) specially programmed in accordance with known blackjack games and or further providing a Lucky High Low blackjack auxiliary game or a second (or third) compatible auxiliary blackjack game adapted for play via an input device 630 for receiving commands and an output device 620 such as a display (or a touchscreen display), for example, as a virtual hand-held telecommunications game. Memory 610 stores all software and parameters of game play. The system of FIG. 6 may be implemented in any form such as a personal computer, personal data assistant, intelligent wireless mobile telephone, tablet computer device, gaming apparatus such as a slot machine or other device known in the art having a secure communications interface 640, an output device such as a display, an input device 630 or combination input/output device such as a touchscreen, and a secure memory 610. It is desirable if the secure memory 610 protects the game computer operating program according to the house rules, the values of wagers, communications with banks or other institutions input by the player 1 for determining and validating wager values and possible winnings. There may be provided a plurality of remote betting positions (greater than the casino limited table limited number of seven), individually selectable and which may be communicated with in parallel rather than serially (since the machine player 1 does not know how many other players there may be playing remotely and requires prompt responses. The processor 600 is actuatable for accepting a wager in credits and physical items of currency as defined above and having an indicated pay-off via output device 620.

Processor 600 is coupled to secure memory 610 for storing a computer implemented method of operation (such as a securely downloaded game application) and rules of play in the form of computer-implemented instructions or sequences of computer code of the auxiliary Lucky High Low game (and other auxiliary blackjack games) per FIGS. 1-5 and descriptions of game play, for example, via a query (how do I play the game? via speech to text conversion). Processor 600 may utilize known artificial intelligence methods of applying the game and house rules to make decisions such as which dealer face-up card to show, what value to issue in physical items for a win, when to collect wagers from remote players. By using artificial intelligence, processor 600 may make decisions in a superior manner to a dealer located at a casino. Secure memory 610 may also receive and store player inputs, calculated pay-offs from processor 600 or via a query via communications interface 640, for example, to a bank or other institution.

Communications interface 640 may be equipped with a local or remote global positioning system (if associated with player or game origination) to make decisions such as whether the game play is legal in a given location, short term memory of wagers made, cards dealt (randomly), hands selected for play by a player of Lucky High Low blackjack, choices to show face-up cards by players and dealers, auxiliary games selected for play and so on. Memory 610 may also receive and store in memory 610 calculated pay-offs received from processor 600 or via query via communications interface 640. Communications interface 640 may also include automatic number identification for identifying where a player 1 is originating a call from, for example, their home or business telephone number or via the internet on a secure path and/or with near field communication to communicate with a player's Apple Pay or Google pay account or credit/debit card so equipped. Besides for fun, a game may be played for game play credits (one may remember pin ball machines giving a winner above a certain score a free game play). The calculated pay-offs offered, play credits, scores, auxiliary hands won and the like may be output via a display or touchscreen 610, 620 (not shown) of output device 620 of either the player or the game originator, such as the casino. Also, the output device 620 may output printable tickets, credits, chips, checks, tokens and the like, any physical items print-out, for example, automatically to a player 1.

Output device 620 may be utilized in conventional blackjack and Lucky High Low or other auxiliary side game play to make pay-outs to players 1 in physical items via a selected manner or according to stored house rules and as described above into the player's plural accounts of the player's identification and choice, if permitted by house rules.

Input device 630 may be utilized in conventional blackjack, and an auxiliary game may comprise a touchscreen display 610, 620 for accepting commands from a player 1 such as whether to show a face down card during Lucky High Low games, values of wagers or parameters (limited by house rules). A touchscreen or keys of a keyboard of an input device 630 may receive new sources of physical items currency or credits or other inputs such as to modify a wager or obtain a "hit" of another card in conventional blackjack. A player may attempt to modify a physical item choice or currency choice from dollars to Euros via input device 630 within house rules.

Also, additional unique features are, for example, that all auxiliary side game wagers are separate from each other. Players must bet specific outcomes shown in FIG. 2 comprising any outcome from suited 3 to a high total of 27, and so on to win after placing a wager and before actuating a deal draw by a virtual (or real) dealer after placing conventional and auxiliary side game wagers. The payoffs shown in FIG. 2 are exemplary only and will vary depending on a selected card game, auxiliary game or additional auxiliary game. The odds display of FIG. 2 may be automatically adjusted as may be further explained via electronic odds and pay-out calculation apparatus via a master data processor not shown for remote game play.

Wagers are placed by adding spaces on a button panel of machine apparatus of FIG. 6 or the positions added to a remote game or to a casino table surface per FIG. 1. Other alternative apparatus may prove wagering spaces on LCD or other display screens or touch screens of a portable apparatus such as an I-Pad. Button or position wagering can vary in number of bets/wagers depending on different pay table variations that may be automatically calculated.

Higher paying outcomes such as the suited three of FIG. 2 or FIG. 3 side blackjack game are achieved by the ability of a player 1 to place a small bet that can turn into a unique bigger payoff not available from standard, conventional blackjack. The games wagering options of Lucky High Low blackjack provide a wider variety of playing that could be appealing in different ways to a wide range of people. A table conventional blackjack game (FIG. 1) having an auxiliary side game may automatically vary quickly from dealer to dealer while a virtual machine operation may provide a greater blackjack casino or game originator input. Consequently, it is advantageous to provide automatic odds and pay-off data as a dealer or virtual machine inputs a selected game to the gaming apparatus or dealer.

Given all of this information and the opportunity that a player now has the unique opportunity for a large jackpot payoff, Lucky High Low blackjack is a game that separates itself from the current variations known of associated standard games of blackjack. Lucky High Low blackjack is also an auxiliary side game that is believed to be highly marketable to the House, a game distributor and to players (fun or profit).

Other blackjack games may be adapted to permit play of Lucky High Low blackjack by one of ordinary skill in the art. A lottery game may be provided by jurisdictions as an instant win game supplemental to a standard blackjack game with predetermined odds for both the standard game and the auxiliary side game where a scratch-off position on a lottery ticket is an auxiliary game position with a predetermined pay off for a predetermined card value. This would be done as long as there would be no conflict with state lottery laws and regulations. Thus, there has been described the play of an auxiliary side game that may be adapted for play with standard video blackjack and blackjack table games with, for example, auxiliary pay-off calculation apparatus or without such apparatus if the blackjack game selected remains constant. The scopes of the several embodiments discussed above should be deemed only limited by the scope of the claims which follow.

What we claim is:

1. Apparatus for playing a card game of conventional blackjack and an auxiliary game to the conventional blackjack game, the apparatus comprising:

an output device, a special purpose computer processor configured to store an algorithm of a virtual dealer in secure memory for executing instructions regarding game play including an instruction for displaying a virtual two card blackjack player hand on the output device responsive to validation and identification of a player monetary wager value in physical items, each physical item having a monetary value in fractional or whole currency values, an input device configured to receive said player monetary value wager to establish a credit value of physical items with which the conventional blackjack and the auxiliary game are played according to house rules of the virtual dealer algorithm stored in secure memory of the special purpose computer processor, the special purpose computer processor configured to validate said player monetary value wager on the conventional blackjack game and the auxiliary game as a total credit value toward blackjack game play in physical items, the input device configured to receive a command input by a player of the auxiliary game to the special purpose computer processor configured to display the two card player hand of the player of the auxiliary game on the output device, the special purpose computer processor configured to also display one of two possible face-up cards selected by the algorithm of the virtual dealer, the secure memory being coupled to the special purpose data processor, the special purpose processor configured to respectively store and calculate a card value of the player's two card virtual blackjack hand and a card value of the selected, displayed face-up card of a two card conventional face card hand of the virtual dealer to obtain a total card value, the special purpose computer processor configured to determine the selected face-up card value using the virtual dealer algorithm stored in the secure memory of the special purpose computer processor, the virtual dealer configured to vary the face-up card value by special purpose computer processor game play experience of the virtual dealer algorithm, the virtual dealer algorithm of the special purpose computer processor configured to determine a winning player two card hand of the auxiliary game by summing a total card value of the virtual dealer selected face-up card and the card values of a player's two card conventional blackjack hand according to a total card value of three, a total card value of four, a total card value of five, a total card value of thirty, a total card value of twenty-nine, a total card value of twenty-eight and a total card value of twenty-seven, the special purpose computer processor configured to determine a value of pay-out physical items, responsive to instructions received from the special purpose computer processor, and configured to deposit the determined value pay-out physical items for the benefit of the player of the auxiliary game and configured to determine no value of pay-out to the player of the auxiliary game if no total winning card values are determined by the virtual dealer algorithm, and the special purpose computer processor, responsive to determining one of the value of pay-out physical items and no value of pay-out to the player of the auxiliary game, proceeding with conventional blackjack game play.

2. The apparatus for playing a card game of conventional blackjack and an auxiliary game to the conventional blackjack game according to claim 1, the apparatus further comprising:

the virtual dealer algorithm of the special purpose processor configured to determine a value of physical pay-out items from a pay table displayed by the output device for benefit of an auxiliary game player, the virtual dealer algorithm configured to pay-out at least one hundred physical pay-out items per at least one physical item received by the apparatus for auxiliary game play for a total card value of three, the virtual dealer algorithm configured to pay-out at least thirty physical pay-out items per at least one physical item received by the apparatus for auxiliary game play for a total card value of four, the virtual dealer algorithm configured to pay-out at least fifteen physical pay-out items per at least one physical item received by the apparatus for auxiliary game play for a total card value of five, the virtual dealer algorithm configured to pay-out at least seven physical pay-out items per at least one physical item received by the apparatus for auxiliary game play for a total card value of thirty, the virtual dealer algorithm configured to pay-out at least four physical pay-out items per at least one physical item received by the apparatus for auxiliary game play for a total card value of twenty-nine, the virtual dealer algorithm configured to pay-out at least three physical pay-out items per at least one physical item received by the apparatus for auxiliary game play for a total card value of twenty-eight, and the virtual dealer algorithm configured to pay-out at least two physical pay-out items per at least one physical item received by the apparatus for auxiliary game play for a total card value of twenty-seven.

3. The apparatus for playing a card game of conventional blackjack and an auxiliary game to the conventional blackjack game according to claim 2, the apparatus further comprising:

the virtual dealer algorithm configured to pay-out at least two hundred physical pay-out items per at least one physical item received by the apparatus for auxiliary game play for a total card value of three, all three cards being of a same suit of a possible four suits of cards.

4. A method of playing a conventional blackjack card game and an auxiliary game to the conventional blackjack card game on a computer implemented machine with a plurality of decks of cards in random order stored in secure memory of the computer implemented machine, ordering the plurality of decks of cards randomly under control of a special purpose computer, the plurality of decks of cards comprising a minimum of three decks of fifty-two cards, the special purpose computer having a virtual dealer algorithm communicating with a remote computer terminal of a player, the virtual dealer algorithm transmitting commands to the player remote computer terminal via a secure communications interface, the commands comprising 1) displaying a decision by the virtual dealer algorithm to actuate a display at the player remote computer terminal of a total card value of a selected face-up card of a virtual dealer blackjack card game hand and of a two card blackjack hand of a player of the auxiliary game, 2) the special purpose computer determining the total card value of the displayed face-up card and of the two card blackjack hand using the virtual dealer algorithm, and, 3) the virtual dealer algorithm of the special purpose computer learning from auxiliary game play, responsive to the plurality of decks of cards, the virtual dealer algorithm selecting the displayed face-up card and two card blackjack hand comprising one auxiliary game virtually dealt by the virtual dealer algorithm for display at the player remote computer terminal, receiving in secure memory of the special purpose computer a total card value of the two card blackjack hand virtually dealt controlled by the virtual dealer algorithm of the special purpose computer and the virtual dealer algorithm controlling display of the selected face-up card value at the player remote computer terminal via the secure communications interface, determining a winning player two card hand by the virtual dealer algorithm of the special purpose computer, the virtual dealer algorithm summing a card value of the virtual dealer algorithm selected face-up card and the card values of the two card conventional blackjack hand of the player and determining a winning auxiliary game hand according to a total card value of a card value of three, a total card value of four, a total card value of five, a total card value of thirty, a total card value of twenty-nine, a total card value of twenty-eight and a total card value of twenty-seven, the special purpose computer, having the virtual dealer algorithm, determining a value of pay-out physical items responsive to instructions received as to deposit or payment of the pay-out physical items for auxiliary game play and determining no value of pay-out if no winning total card values are displayed by the player remote computer terminal each physical item having a monetary value in fractional or whole currency values, the special purpose computer, responsive to the determining step of determining one of a value of pay-out physical items and no value of pay-out, proceeding with conventional blackjack game play.

5. The method of playing a conventional blackjack card game and an auxiliary game to the conventional blackjack card game of claim 4 on a computer implemented machine with a plurality of decks of cards in random order stored in secure memory of the computer implemented machine, the method further comprising:

paying out a pay-out of at least one hundred physical pay-out items per at least one physical item received for auxiliary game play for a total card value of three, paying out a pay-out of at least thirty physical pay-out items per at least one physical item received for auxiliary game play for a total card value of four, paying out a pay-out of at least fifteen physical pay-out items per at least one physical item received for auxiliary game play for a total card value of five, paying out a pay-out of at least seven physical pay-out items per at least one physical item received for auxiliary game play for a total card value of thirty, paying out a pay-out of at least four physical pay-out items per at least one physical item received for auxiliary game play for a total card value of twenty-nine, paying out a pay-out at least three physical pay-out items per at least one physical item received for auxiliary game play for a total card value of twenty-eight, and paying-out a pay out of at least two physical pay-out items per at least one physical item received for auxiliary game play for a total card value of twenty-seven.

6. The method of playing a conventional blackjack card game and an auxiliary game to the conventional blackjack card game of claim 5 on a computer implemented machine with a plurality of decks of cards in random order stored in secure memory of the computer implemented machine, the method further comprising:

paying out a pay-out of at least two hundred physical items per at least one physical item received for auxiliary game play for a total card value of three, all three cards being of a same suit of a possible four suits of cards.

7. A surface of a blackjack table and a special purpose computer having a virtual dealer algorithm for play of conventional blackjack and an auxiliary game, the blackjack table surface comprising:

a conventional blackjack game betting spot of a player position of the blackjack table game surface comprising a portion of a circle, a blackjack auxiliary game betting spot of the player position further comprising one of a square and a rectangle, the player position of the blackjack table surface further comprising a portion of the blackjack table surface, each of at least two table positions of a plurality of table positions of the blackjack table surface configured to display a payout table for the blackjack auxiliary game, the payout table determined by the virtual dealer algorithm of the special purpose computer, the virtual dealer algorithm configured to calculate a sum of total blackjack auxiliary game card values to determine a winning hand of the blackjack auxiliary game, the surface of the blackjack table configured to receive a selected face-up card of a virtual dealer hand and a two card blackjack hand determined by the virtual dealer algorithm, the face-up card selected from a conventional two card dealer hand by the virtual dealer algorithm of the special purpose computer, responsive to received card values of the conventional two card blackjack card hand received at one of the plurality of player positions and the selected face-up card of the virtual dealer hand, the virtual dealer algorithm, according to game rules, configured to calculate a total card value of three, a total card value of four, a total card value of five, a total card value of thirty, a total card value of twenty-nine, a total card value of twenty-eight and a total card value of twenty-seven, the blackjack table card surface configured to receive at a winning blackjack auxiliary game player position one of a plurality of physical items and no physical items, each physical item having a monetary value in fractional or whole currency values the special purpose computer, responsive to the blackjack table top surface receiving the one of the plurality of physical items and no physical items from the blackjack auxiliary game, proceeding with conventional blackjack game play.

8. The surface of a blackjack table and a special purpose computer having a virtual dealer algorithm for play of conventional blackjack and an auxiliary game of claim 7, the blackjack table surface and special purpose computer further comprising:

the at least two blackjack table surface table positions for the auxiliary game play configured to display the pay table, the pay table displaying a pay-out of at least one hundred physical items per at least one physical item for auxiliary game play for a total card value of three, the at least two blackjack table surface table positions for the auxiliary game play configured to display the pay table, the pay table displaying a pay-out of at least thirty physical items per at least one physical item for auxiliary game play for a total card value of four, the at least two blackjack table surface table positions for the auxiliary game play configured to display the pay table, the pay table displaying a pay-out of at least fifteen physical items per at least one physical item for auxiliary game play for a total card value of five, the at least two blackjack table surface table positions for the auxiliary game play configured to display the pay table, the pay table displaying a pay-out of at least seven physical items per at least one physical item for auxiliary game play for a total card value of thirty, the at least two blackjack table surface table positions for the auxiliary game play configured to display the pay table, the pay table displaying a pay-out of at least four physical items per at least one physical item for auxiliary game play for a total card value of twenty-nine, the at least two blackjack table surface table positions for the auxiliary game play configured to display the pay table, the pay table displaying a pay-out of at least three physical items per at least one physical item for auxiliary game play for a total card value of twenty-eight, and the at least two blackjack table surface table positions for the auxiliary game play configured to display the pay table, the pay table displaying a pay-out of at least two physical items per at least one physical item for auxiliary game play for a total card value of twenty-seven.

9. The surface of a blackjack table and a special purpose computer having a virtual dealer algorithm for play of conventional blackjack and an auxiliary game of claim 8, the blackjack table surface and special purpose computer further comprising:

the at least two blackjack table surface table positions for the auxiliary game play configured to display the pay table, the pay table displaying a pay-out of at least two hundred physical items per at least one physical item for auxiliary game play for a total card value of three, all three cards being of a same suit of a possible four suits of cards.

* * * * *